United States Patent [19]

Moriya

[11] 4,421,235

[45] * Dec. 20, 1983

[54] OXYGEN ABSORBENT-CONTAINING BAG AND CONTAINER SEALING MEMBER HAVING THE SAME

[75] Inventor: Takehiko Moriya, Tokyo, Japan

[73] Assignee: Mitsubishi Gas Chemical Co. Inc., Tokyo, Japan

[ * ] Notice: The portion of the term of this patent subsequent to Sep. 8, 1998 has been disclaimed.

[21] Appl. No.: 315,660

[22] Filed: Oct. 21, 1981

Related U.S. Application Data

[63] Continuation of Ser. No. 119,876, Feb. 8, 1980, abandoned.

[30] Foreign Application Priority Data

Feb. 8, 1979 [JP] Japan ..... 54-15076
May 7, 1980 [JP] Japan ..... 55-60323

[51] Int. Cl.[3] ..... B65D 85/84; A61B 17/06

[52] U.S. Cl. ..... 206/524.2; 206/439; 206/484.1; 215/228; 426/124; 426/398; 428/35

[58] Field of Search ..... 206/439, 484.1, 524.2; 426/124, 398, 418; 215/228; 428/35

[56] References Cited

U.S. PATENT DOCUMENTS

| | | | |
|---|---|---|---|
| 3,035,730 | 5/1962 | Walker | 215/228 |
| 3,254,784 | 6/1966 | Lancesseur | 215/228 |
| 4,055,672 | 10/1977 | Hirsch et al. | 206/439 |
| 4,104,192 | 8/1978 | Yoshikawa et al. | 426/544 |
| 4,113,652 | 9/1978 | Yoshikawa et al. | 426/124 |
| 4,127,503 | 11/1978 | Yoshikawa et al. | 252/429 R |
| 4,166,807 | 9/1979 | Komatsu et al. | 252/429 R |
| 4,192,773 | 3/1980 | Yoshikawa et al. | 426/124 |
| 4,199,472 | 4/1980 | Ohtsuka et al. | 252/427 |
| 4,287,995 | 9/1981 | Moriya | 426/124 |

*Primary Examiner*—William R. Dixon, Jr.
*Attorney, Agent, or Firm*—Browdy and Neimark

[57] ABSTRACT

A bag in which an oxygen absorbent is sealed, is characterized in that at least part of the material constituting the bag is composed of a film having a plurality of fine openings, and being gas-permeable, but water-impermeable at one atmospheric pressure, and a container sealing member in which the bag is in a space inside the member are disclosed. The bag is used for preserving an aqueous liquid or semi-liquid material, such as foodstuffs and other materials.

4 Claims, 21 Drawing Figures

OXYGEN ABSORBENT-CONTAINING BAG AND CONTAINER SEALING MEMBER HAVING THE SAME

This is a continuation of application Ser. No. 119,876 filed Feb. 8, 1980 now abandoned.

BACKGROUND OF THE INVENTION

This invention relates to a bag having an oxygen absorbent, characterized in that at least part of the material constituting the bag is composed of a film having a plurality of fine openings, and being gas-permeable, but water-impermeable at one atmospheric pressure. The bag is used for preserving an aqueous liquid or semi-liquid material, such as foodstuffs and other materials.

In order to preserve foodstuffs, such as soy sauce, Japanese sake, sauce, wine, beer, juice, vinegar, etc., it is necessary to prevent the foodstuffs from getting moldy and from putrefying. In the prior art methods, the gas present in the inner part of a content-charged container was replaced by an inert gas or the container was sterilized. However, replacement of oxygen by an inert gas requires large-scale apparatus and sterilization of the filled container may cause change in quality of the contents. Additives, such as antioxidants, have been used for preserving foodstuffs. However, recently, governments have started to regulate the use of additives for foods, since some additives have been found to be injurious to humans.

Molds or eumycetes, bacteria and higher organisms such as insects tend to disturb preservation of foodstuffs. These mold eumycetes, bacteria and insects live and grow in the presence of oxygen and cause putrefaction and change in quality of foodstuffs.

Therefore, if oxygen can be selectively removed from the empty space of the filled container, the problems of putrefaction and change in quality of foodstuffs can be overcome, and it will become possible to preserve foodstuffs for extended periods.

SUMMARY OF THE INVENTION

One object of this invention is to provide a bag having an oxygen absorbent, which can be placed in a package for preserving foodstuffs.

Another object of this invention is to provide a bag being capable of absorbing oxygen.

A further object of this invention is to provide a container sealing member in which the bag is in a space inside the member.

This invention relates to a bag in which an oxygen absorbent is sealed, characterized in that at least part of the material constituting the bag is composed of a film having a plurality of fine openings, and being gas-permeable, but water-impermeable at one atmosphere of pressure.

This invention also relates to a container sealing member in which the bag as mentioned above is in a space of the member.

BRIEF EXPLANATION OF THE INVENTION

FIG. 1 is a plan view of the bag and FIG. 2 is a fragmentary sectional view of the bag along II—II line of FIG. 1;

FIG. 3 is a plan view of the bag and FIG. 4 is a fragmentary sectional view of the bag along IV—IV line of FIG. 3;

DETAILED EXPLANATION OF THE INVENTION

The term "oxygen absorbent" in the specification and the claims means an agent for absorbing or removing oxygen present in the atmosphere of the container. Examples of the oxygen absorbents employed in the practice of this invention are disclosed in U.S. Pat. No. 4,113,652 by Yoshikawa et al patented on Sept. 12, 1978; U.S. Pat. No. 4,104,192 by Yoshikawa et al patented on Aug. 1, 1978; U.S. Pat. No. 4,199,472 by Ohtsuka et al; U.S. Pat. No. 4,127,503 patented on Nov. 28, 1978; U.S. Pat. No. 4,166,807 by Komatsu et al; and U.S. Pat. No. 4,192,773 by Yoshikawa et al filed which are incorporated herein by reference. Examples of the oxygen absorbents include reducing agent, such as iron powder, oxalates, sulfites, hydrogen sulfites, dithionites, pyrogallol, Rongalit, glucose, copper amine complex, zinc powder and the like, and any composition containing the reducing agent. A solid oxygen absorbent, a solid carrier impregnated with a liquid or semi-liquid oxygen absorbent, or a liquid or semi-liquid oxygen absorbent can be used as the oxygen absorbent of this invention. The solid oxygen absorbent and the solid carrier impregnated with the liquid or semi-liquid oxygen absorbent are preferred.

The film (sometimes hereinunder referred to as gas permeable film) having a plurality of fine openings or holes and being gas-permeable, but water-impermeable at one atmosphere pressure are well known. The size of the openings is conveniently in the range of 0.01–45 microns. The film having a plurality of elongated openings each having a distance of less than 2 microns across the short axis is preferable. Materials constituting the film include plastics, such as polyethylene, polypropylene, poly(fluorinated ethylene) and the like. The gas-permeable film employed in the practice of this invention may be prepared by: cold orientation of untreated film; orientation of different substance-containing film; extraction of different substance from different substance-containing film; extracting different substance-containing film, followed by orientating the so-treated film; and irradiating untreated film with electron beam. Suitable gas permeable films are commercially available, and are sold under the names Celgard (Celanese Corp.), FP-2 (Asahi Chemical Industry), NOP (Nippon Oil Chemical Co., Ltd.), Nitto Flon (NTF) (Nitto Electric Industrial Co., Ltd.) and Cellpore NW01 (Sekisui Chemical Co., Ltd.).

Figure 1:
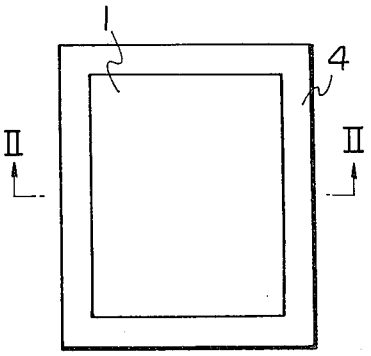
FIGS. 1 and 2 show a first embodiment of the bag of this invention.
Figure 2:
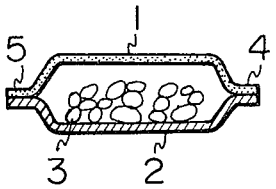

FIGS. 1 and 2 show one embodiment. The elements are: gas permeable film 1; gas impermeable film 2 and oxygen absorbent 3. The edge portions of films 1 and 2 are heat-sealed so as to seal therebetween oxygen absorbent 3. The sealed portion is shown at 4. The bag may be made of only the gas permeable film. However, the gas permeable film is costly, so it is preferable that one of the two films constituting the bag be a gas permeable film. Examples of the gas impermeable films include polyethylene film, polypropylene film, poly(fluorinated ethylene) and the like. Of course, the gas impermeable film is water impermeable. The materials of the two films may be the same or different. The edges of the two films may be adhered by using an adhesive.

Figure 4:
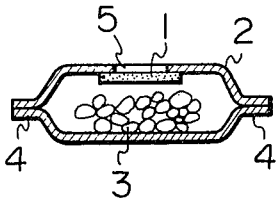
FIGS. 3 and 4 show the second embodiment of the bag of this invention.
Figure 3:
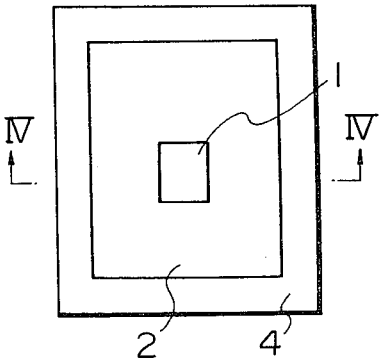

FIGS. 3 and 4 show a second embodiment of the bag. In the embodiment, water impermeable films 2 are used as upper and lower side films constituting the bag. Hole 5 is made in one of the two films 2. Gas permeable film 1 is adhered to film 2 by means of heat sealing or an adhesive so as to cover the hole.

Figure 5:
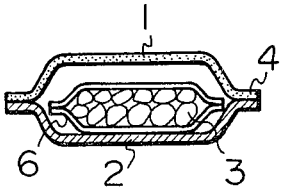
FIGS. 5–8 are a fragmentary sectional view each of the third through seventh embodiments of the bag of this invention.

FIG. 5 shows a third embodiment of the bag. In the embodiment, before an oxygen absorbent is sealed in the bag, it is wrapped with a gas and water permeable material 6, such as paper, non-woven fabric or perforated plastic film.

Figure 6A:
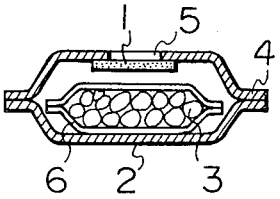

FIG. 6(*a*) shows a fourth embodiment of the bag. In the embodiment, before an oxygen absorbent is sealed in the bag, it is wrapped with the gas and water permeable material 6 as employed in the third embodiment, i.e. FIG. 5.

Figure 6B:
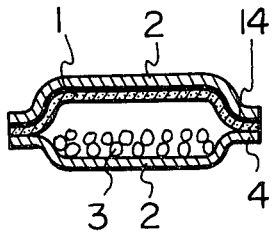

FIG. 6(b) shows a fifth embodiment of the bag. In the embodient, a second gas impermeable film 2 is adhered in a peelable manner over the gas permeable film 1 of the bag as shown in the first embodiment. The bag in which the second impermeable film 2 is adhered over the gas permeable film 1 does not exhibit oxygen-absorbing function. Only when the second gas impermeable film 2 is peeled from gas permeable film 1, does the bag exhibits oxygen absorbent function. The second gas impermeable film covering a gas permeable film may be adhered in a peelable manner over hole 5 of the bag as shown in the second embodiment i.e. FIGS. 3, 4.

Figure 7:
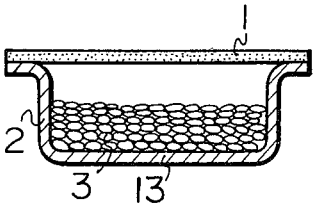

FIG. 7 shows a sixth embodiment of the bag. In this embodiment, concavity 13 is formed in the gas impermeable film or sheet 2. After an oxygen absorbent 3 is placed in the concavity, the gas permeable film 1 is adhered to film or sheet 2 by means of heat-sealing or an adhesive to form a bag of the present invention.

Figure 8:
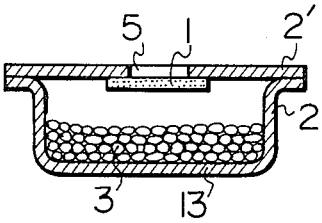

FIG. 8 shows a seventh embodiment of the bag. In this embodiment, another gas and water-impermeable film 2 is adhered to film or sheet 2 containing an oxygen absorbent as shown in the fifth embodiment, FIG. 6(*a*). Hole is made in film 2; and gas permeable film 1 is adhered to film 2 by means of heat-sealing or an adhesive so as to cover the hole. Examples of the gas-impermeable film or sheet include polyvinylchloride or polystyrene film or sheet.

The bags as described above can be used for preserving foodstuffs. For example, when the bag is packed with foodstuff in a package film so as to seal the bag and the foodstuff, the oxygen absorbent contained in the bag absorbs oxygen present in the package, whereby putrefaction or change in quality of the foodstuff can be prevented. The bags can be also used for preserving materials other than foodstuffs.

Since the gas impermeable film as well as the gas permeable film constituting the bag is water impermeable at one atmospheric pressure, the bag can be packed with liquid or semi-liquid foodstuffs. In this case, the oxygen absorbent present in the bag is completely prevented from contact with the liquid or semi-liquid foodstuffs of a container, so the contamination of the foodstuffs can be eliminated.

A plurality of concavities may be formed in a gas impermeable sheet and an oxygen absorbent may be placed in each concavity; then a gas permeable film is placed over the sheet so as to cover it and is adhered to the sheet. The so-covered sheet is then cut so as to separate the plurality of bags into single bags.

The bag of this invention can be held in a space inside a container sealing member. When the container sealing member having an oxygen absorbent is placed on, fitted over or inserted in a container, oxygen present in the container is absorbed by the oxygen absorbent.

FIGS. 9–20 show many embodiments of container sealing member holding the bag in a space inside the member. The drawings are only for illustration; and structure of the container sealing member is not limited by the drawings. Any one of the bags as shown in the above embodiments may be held in each of the container sealing members as shown in the following drawings.

The container sealing member of this invention includes cap placed on or fitted over a container, and stopper inserted in a container.

Figure 9:
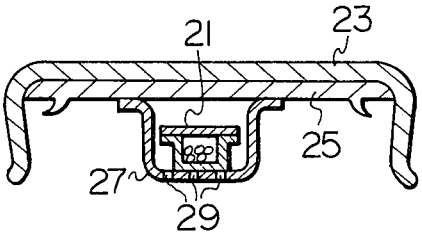
FIGS. 9–13 are a fragmentary sectional view each of different container sealing members of this invention.

FIG. 9 shows a first embodiment of the container sealing member of this invention. The sealing member is a crown cap assembly. The elements are: bag 21; crown cap 23; elastic packing member 25; bag-holding member 27; and holes 29. When the crown cap assembly is fitted over a container, oxygen present in the container passes through holes 29 and is absorbed by the oxygen absorbent present in the bag. Crown cap 23 may be made of a metallic material, such as aluminum, iron and the like or a plastic material, such as polyvinyl chloride, polystyrene, polycarbonate, polyethylene, polypropylene and the like. Elastic packing member 25 serves to seal the mouth of the container and may be made of cork plate, polyethylene plate, foamed polystyrene sheet, foamed polyethylene sheet, synthetic rubber sheet, plastic sheet and the like.

Figure 10:
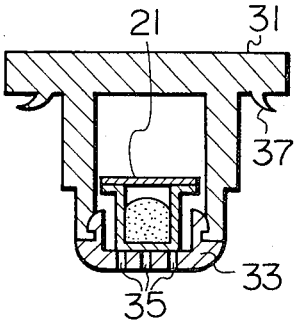

FIG. 10 shows a second embodiment of the container sealing member of this invention. The elements are: Bag 21; stopper 31; bag-holding member 33; holes 35 and annular flange 37. Stopper 31 and bag-holding member 33 may be made of polyethylene, polypropylene or the like.

Figure 11:
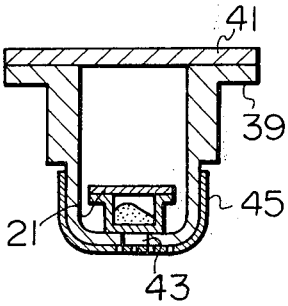

FIG. 11 shows a third embodiment of the container sealing member of this invention. The elements are: stopper 39; cover 41; hole 43; perforated aluminum foil 45 and bag 21. Bag-holding chamber is formed by stopper 39 and cover 41. Stopper 39 and cover 41 may be made of polyethylene, polypropylene or the like. Stopper 39 is adhered to cover 41 by means of heat sealing or an adhesive.

Figure 12:
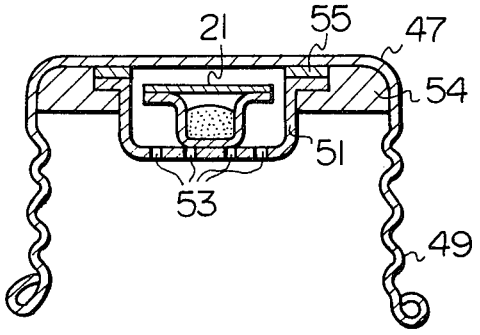

FIG. 12 shows a fourth embodiment of the container sealing member. The elements are: cap 47; threaded portion 49 of cap 47; bag-holding member 51; holes 53; packing member 54; adhesive 55 and bag 21. Cap 47 may be made of a metallic material, such as aluminum, iron and the like or a plastic material, such as polyethylene, polypropylene, polyvinyl chloride, polystyrene, polycarbonate and the like. Packing member 54 serves to seal the mouth of the container and may be made of cork plate, polyethylene plate, foamed polystyrene sheet, foamed polyethylene sheet, synthetic rubber sheet and the like.

Figure 13:
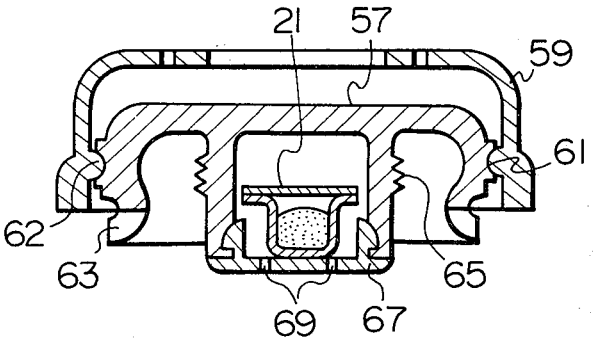

FIG. 13 shows a fifth embodiment of the container sealing member. After cap 57 is inserted into the mouth of a container, clamp 59 is fastened on cap 57 by fastening portion 61. Other elements are: bag 21; depression 63; sealing 65; bag-holding member 67 with holes 69. Annular convex detent 62 is provided on clamp 59 and annular convex groove 61 is provided in cap 59 for mating with the detent 62.

Figure 14:
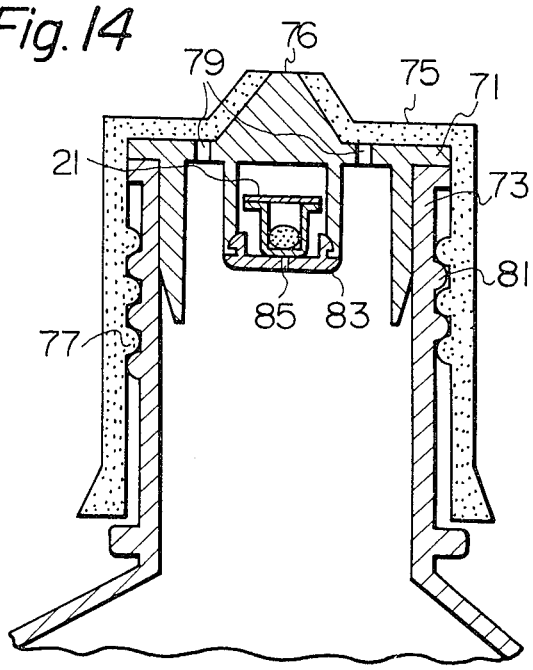
FIG. 14 is a fragmentary sectional view of a container sealing member fitted over a container.

FIG. 14 shows a sixth embodiment of the container sealing member. The elements are: stopper assembly 71 which is inserted in container mouth 73; covering cap 75 which is put over stopper assembly 69; exit 76; threaded portion 77; passage 79; threaded portion 81; bag 21; and bag-holding member 83 with holes 85. The inner surface of the covering cap contacts the outer surface of the stopper assembly when the covering cap is tightened to close exit 76 and passage 79. When the covering cap is loosened, exits 76 and 79 are opened, whereby the contents of the container can be discharged.

Figure 15:
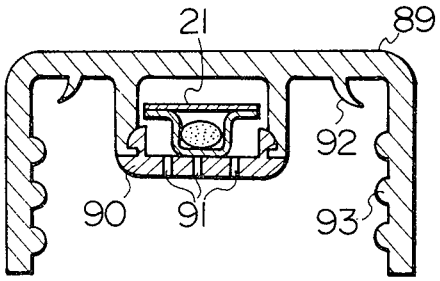
FIGS. 15–18 are a fragmentary sectional view each of different container sealing members of this invention.

FIG. 15 shows a seventh embodiment with cap assembly 89. The other elements are: bag 21; bag-holding member 90 with holes 91; annular flange 92 and threaded portion 93. The cap assembly does not have any packing member.

Figure 16:
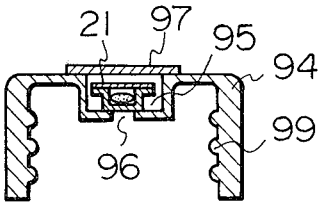

FIG. 16 shows an eighth embodiment of the container sealing member. The elements are: cap assembly 94; bag 21; bag-holding chamber 95; hole 96; cover 97 and threaded portion 99.

Figure 17:
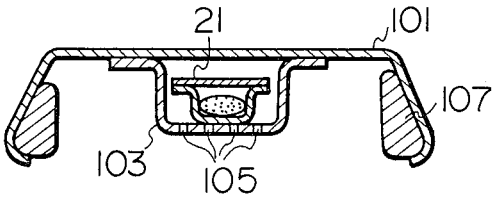

FIG. 17 shows a tenth embodiment comprising: container mouth 42 which is inserted in cap assembly 101; bag 21; bag-holding member 103 with holes 105; and gasket 107. When the container mouth is inserted in cap assembly 101, gasket 107 contacts the outer surface of the mouth.

Figure 18:
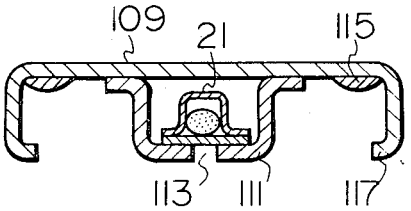

FIG. 18 shows an eleventh embodiment of the container sealing member. The elements are: cap assembly 109; bag 21; bag-holding member 111 with hole 113; elastic material 115; and annular flange 117. Cap assembly 109 is installed on the container mouth by fastening portion. The container is sealed by elastic material 115 of cap assembly 107.

Figure 19:
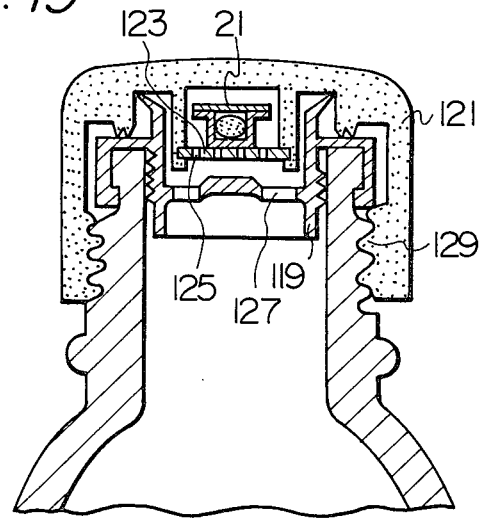
FIG. 19 is a fragmentary sectional view of a container sealing member fitted over a container.

FIG. 19 shows a twelfth embodiment of the container sealing member. The elements are: stopper assembly 119 which is inserted in the container mouth; covering cap 121 which is put over stopper assembly 119; bag 21; bag-holding member 123; holes 125; hole 127; threaded portion 129.

Figure 20:
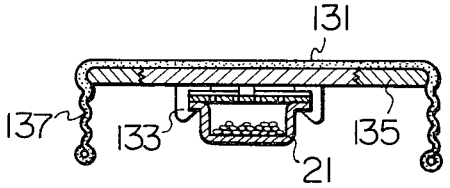
FIG. 20 is a fragmentary sectional view of a container sealing member.

FIG. 20 shows a thirteenth embodiment of the container sealing member. The elements are: cap 131; bag 21; bag-holding member 133; elastic sheet 135 and threaded portion 137.

In all the embodiments the material of the cap, cover and covering cap may be a metal, such as iron, aluminum and the like, or a plastic, such as polyethylene, polypropylene, polyvinyl chloride, poly(fluorinated ethylene) and the like.

When a container sealing member having the bag is placed on, fitted over, or inserted in a container mouth, the bag absorbs oxygen present in the container. So, putrefaction or change in quality of liquid or semi-liquid a content contained in the container can be prevented. The oxygen absorbent is sealed in a bag composed of a gas permeable film and a gas and water impermeable film. Even when the liquid or semi-liquid content contacts the bag, the two films constituting the bag prevent contact of the oxygen absorbent with the container contents, whereby contamination of the contents can be prevented.

The container sealing member can be used for preserving foodstuffs as well as other materials contained in a container.

The advantage of this invention is further illustrated by the following Examples. However, this invention should not be limited by these examples. The percent and parts in the examples are based on weight unless otherwise specified.

EXAMPLE 1

A number of 500 ml bottles were charged with 440 ml of Japanese sake (special grade) leaving a space of 60 cc. Air was present in the space. One half of the bottles were covered with the present container sealing member as explained in the first embodiment and the other half with prior art cap assembly not having the bag of this invention. The oxygen absorbent present in the cap assembly comprises 100 parts of iron powder, 0.4 parts of NaCl and 1 part of activated carbon. The bottles were maintained at 40° C. An organoleptic taste test was carried out.

The taste was evaluated by the following five ratings:

| Ratings | | | | |
|---|---|---|---|---|
| 5 | 4 | 3 | 2 | 1 |
| good taste | ⟷ | bad taste | | spoiled |

The results are shown in Table 1.

TABLE 1

| | | Number of Months after covering with cap assembly (%) | | | | | | |
|---|---|---|---|---|---|---|---|---|
| | | initial | 1 | 2 | 3 | 6 | 9 | 12 |
| Cap assembly of this invention | change in concentration of oxygen in the bottle with time (%) | 18.3 | less than 0.1 | | | | | |
| | taste test | 5 | 5 | 5 | 5 | 5 | 5 | 5 |
| Cap assembly of prior art | change in concentration of oxygen in the bottle with time (%) | 18.4 | 18.3 | 17.6 | 17.1 | 16.2 | 15.8 | 14.1 |
| | taste test | 5 | 5 | 5 | 4 | 3 | 2 | 2 |

EXAMPLE 2

A number of 1.8 l bottles were charged with 1730 ml of soy sauce leaving a space of 70 cc. Air was present in the space. One half of the bottles were covered with the container sealing member as explained in the third embodiment of this invention and the other half with the prior art crown cap assembly not having any oxygen absorbent. The oxygen absorbent present in the cap assembly was the same as that used in Example 1. The bottles were maintained at 40° C. The growing of mold was observed in the conventionally capped bottles.

The results are shown in Table 2.

TABLE 2

| | | Number of days after covering with cap assembly (%) | | | | | |
|---|---|---|---|---|---|---|---|
| | | initial | 1 | 2 | 3 | 7 | 14 |
| Cap assembly of this invention | change in concentration of oxygen in the bottle with time (%) | 20.9 | 4 | | less than 0.1 | | |
| | thickness of mold | | | no mold | | | |
| Cap assembly of prior art | change in concentration of oxygen in the bottle with time (%) | 20.9 | 20.1 | 19.5 | 18.9 | 18.0 | 17.4 |
| | thickness of mold | | no mold | | 1* mm | 2.5* mm | 5* mm |

*Thickness of mold present on the surface of soy sauce.

EXAMPLE 3

A number of 1.8 l bottles were charged with 1730 ml of soy sauce leaving a space of 70 cc. Air was present in the space. One half of the bottles were covered with the container sealing member as explained in the fourth embodiment of this invention and the other half with the prior art crown stopper assembly not having any oxygen absorbent. The oxygen absorbent present in the stopper assembly was the same as that employed in Example 1. The bottles were maintained at 40° C. The growing of mold was observed.

The results are shown in Table 3.

TABLE 3

| | | Number of days after covering with stopper assembly | | | | | | | |
|---|---|---|---|---|---|---|---|---|---|
| | | initial | 1 | 2 | 3 | 7 | 15 | 30 | 40 |
| Cap assembly of this invention | change in concentration of oxygen in the bottle with time (%) | 21 | 2 | | | less than 0.1 | | | |
| | thickness of mold | | | | no mold | | | | |
| Cap assembly of prior art | change in concentration of oxygen in the bottle with time (%) | 21 | 20.7 | 20.4 | 20.2 | 19.8 | 19.6 | 19.1 | 18.0 |
| | thickness of mold | | no mold | | slight mold | 2* mm | 6* mm | 8* mm | 9* mm |

*Thickness of mold present on the surface of soy sauce.

What is claimed is:

1. A bag in which an oxygen absorbent is sealed, characterized in that at least part of the material constituting the bag is composed of a film having a plurality of fine openings in the range of 0.01 to 45 microns, and being gas-permeable, but water-impermeable at one atmospheric pressure.

2. The bag as defined in claim 1 wherein the film has a plurality of elongated openings each having a distance of less than 2 microns across the short axis.

3. The bag as defined in claim 1 wherein the oxygen absorbent contains an iron powder as a reducing agent.

4. The bag as defined in claim 1 wherein a gas impermeable film is adhered over said film in a peelable manner.

* * * * *

UNITED STATES PATENT AND TRADEMARK OFFICE

CERTIFICATE OF CORRECTION

PATENT NO. : 4,421,235

DATED : December 20, 1983

INVENTOR(S) : Takehiko MORIYA

It is certified that error appears in the above-identified patent and that said Letters Patent are hereby corrected as shown below:

Title page, [30] Foreign Application Priority Data second priority data should read:

--May 7, 1979 [JP] Japan ..... 54-60323--

Signed and Sealed this

Seventh Day of August 1984

[SEAL]

Attest:

GERALD J. MOSSINGHOFF

Attesting Officer

Commissioner of Patents and Trademarks